US005487256A

United States Patent [19]

Janhonen

[11] Patent Number: 5,487,256

[45] **Date of Patent: *Jan. 30, 1996**

[54] PACKAGING METHOD FOR WRAPPING BOOKS OR THE LIKE

[75] Inventor: Veikko Janhonen, Helsinki, Finland

[73] Assignee: Pussikesku Oy, Helsinki, Finland

[ * ] Notice: The portion of the term of this patent shall not extend beyond the expiration date of Pat. No. 5,410,862.

[21] Appl. No.: 372,059

[22] Filed: Jan. 12, 1995

Related U.S. Application Data

[63] Continuation of Ser. No. 253,957, Jun. 3, 1994, Pat. No. 5,410,862.

[30] Foreign Application Priority Data

Jun. 14, 1993 [FI] Finland ..... 932730

[51] Int. Cl.[6] ..... B65B 11/00

[52] U.S. Cl. ..... 53/461; 53/466; 53/373.2; 53/373.3

[58] Field of Search ..... 53/218, 461, 209, 53/373.3, 373.2, 588, 590, 228, 215, 586, 221, 375.6, 462, 466

[56] References Cited

U.S. PATENT DOCUMENTS 4,570,422 2/1986 Watanabe et al. .
4,627,223 12/1986 Janhonen .
4,930,293 6/1990 Hanscom .
4,956,961 9/1990 Janhonen .
4,972,653 11/1990 Janhonen .
5,115,618 5/1992 Janhonen .
5,248,034 9/1993 Janhonen .

FOREIGN PATENT DOCUMENTS 273240 7/1988 European Pat. Off. .
378787 7/1990 European Pat. Off. .

*Primary Examiner*—John Sipos
*Assistant Examiner*—Ed Tolan
*Attorney, Agent, or Firm*—Price, Heneveld, Cooper, DeWitt & Litton

[57] ABSTRACT

The invention relates to a packaging machine for wrapping books or the like for postal deliveries. The package blank includes a rectangularly shaped outer cardboard (2), which is folded by means of transverse belts (5) from a flat condition to a tube surrounding the four sides of a book. The belts (5) extend through sliding slots included in the bottom edge of guides (8) and said guides (8) are operated in vertical and horizontal plane by means of pneumatic cylinders (11, 14). The apparatus also requires two sets of individually operable press plates (6 and 7) for pressing the package from above before and after the folding of a sheet of cardboard (2).

16 Claims, 4 Drawing Sheets

PACKAGING METHOD FOR WRAPPING BOOKS OR THE LIKE

CROSS REFERENCE TO RELATED APPLICATION

This is a continuation of application Ser. No. 08/253,957, filed Jun. 3, 1994, by Veikko Janhonen for "Packaging Machine for Wrapping Books or the Like", now U.S. Pat. No. 5,410,862.

The present invention relates to a packaging machine for wrapping books or the like for postal deliveries by using a package blank, including a rectangularly shaped outer cardboard, said machine comprising a conveyor track, an adhesive application station alongside the conveyor track upstream of a wrapping station, a wrapping station which includes folding elements on either side of the conveyor track for folding said outer cardboard from a flat condition to a tube surrounding the four sides of a book, and a press element operable in vertical direction above the conveyor track for pressing the overlapped ends of the outer cardboard against the top surface of a book in view of fastening the ends to each other by means of an adhesive applied therebetween.

This type of packaging machine is prior known from the Applicant's Patent publications EP-0,273,240 and EP-0,378,787. These prior known devices are very useful but their construction is quite complicated and the price is high. The former has a little less complicated construction but it is respectively slower in operation.

An object of the invention is to provide an improved packaging machine which has a simple construction and is inexpensive in relation to production capacity.

A further object of the invention is to provide an improved packaging machine for wrapping books of varying sizes, a plurality of books or piles of documents.

These objects are achieved by means of a packaging machine of the invention, which is characterized in that the wrapping station is further provided with second press elements, including a horizontal press plate which has one unsupported end and is operable both in vertical direction and in the direction of the conveyor track by means of individually controlled power units, and that said folding elements include transverse belts which extend through sliding slots included in the bottom edge of guides, said guides being adapted to be operable in vertical and horizontal plane by means of power units, whose automatic control moves the guides first upwards, then towards each other, and then alternately downwards in such a manner that the belts are first elevated from the conveyor track level as said second press elements press the top side of the package blank, whereby said belts fold the end sections of the outer cardboard first upwards and then alternately on top of each other in an overlapping fashion while said second press elements travel in the direction of the conveyor track for retracting said press plate from underneath the folded end sections of the outer cardboard.

Thus, the transverse belts perform the entire outer cardboard folding operation and there is no need for elevating and lowering the track level.

In view of eliminating the need of the preliminary centering of a package on the conveyor track, yet effecting the folding of both sides with a suitable tension without excessive pressing, in a preferred embodiment of the invention, the wrapping station includes sensor elements, which travel along with the guides and collide with the sides of a package blank as the end sections of the outer cardboard are upright in a position inclined towards each other, one of said guides stopping or decelerating its motion with the other guide effecting a stroke downwards. However, it is possible to replace the sensor elements with means for centering a package blank on the track, as disclosed e.g. in Patent publication EP-0,378,787.

The invention will now be described in more detail with reference made to the accompanying drawings, in which FIG. 1 shows schematically a packaging machine of the invention without depicting all of the components included in a wrapping station;

Figure 1:
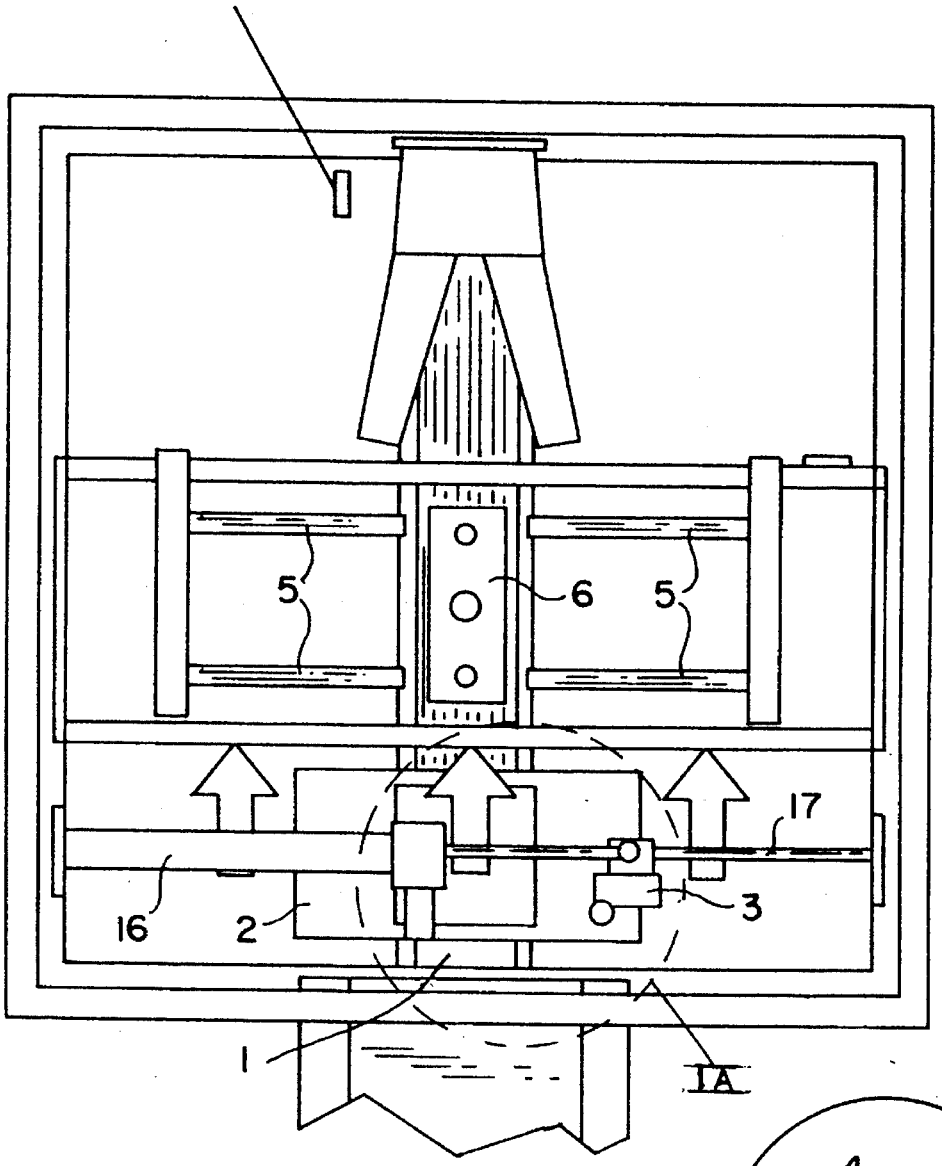
FIG. 1A is a perspective view of the area of the packaging machine of the invention outlined in area IA of FIG. 1.
Figure 1A:
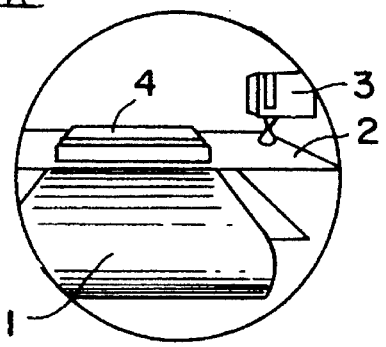
Figure 2:
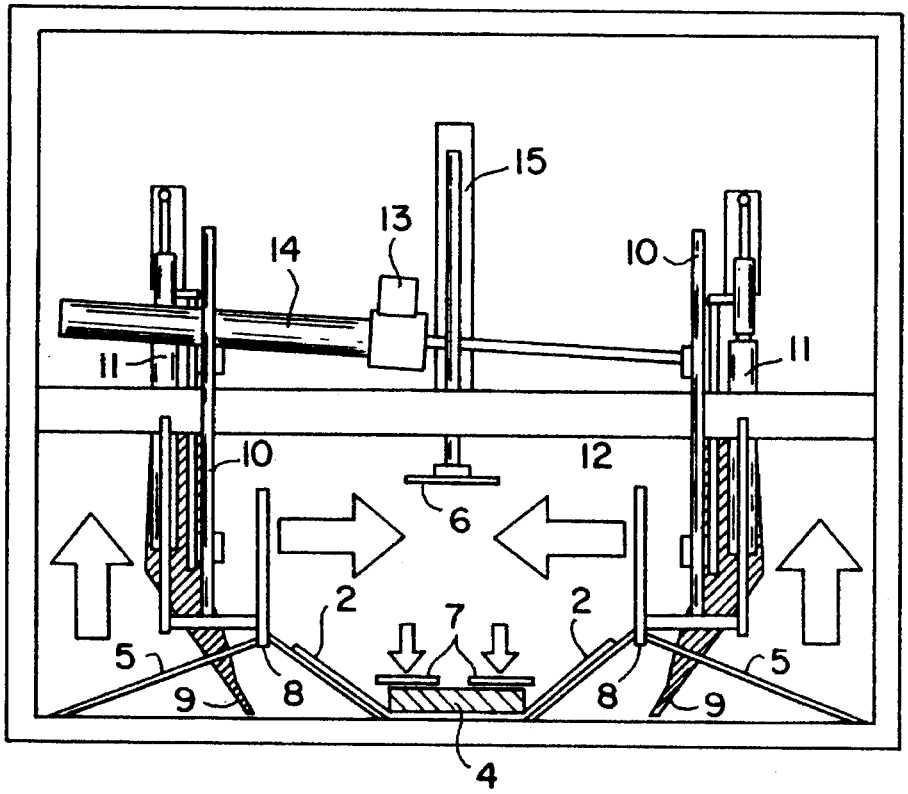
FIG. 2 shows the same machine viewed in the track direction at the initial stage of wrapping with all essential components of a wrapping station depicted.

In reference to FIGS. 1 and 2, the overall machine construction will now be described. A package blank 2, 4 is carried on a conveyor track 1 into a wrapping station. A typical package blank is such that one or more books or a pile of documents are enclosed in an inner wrapper 4 of paper surrounding the four sides of a book. This preliminary wrapping operation can be performed manually, since the flexible inner wrapper is easy to handle. On the other hand, the folding of a rather stiff outer cardboard 2 is effected according to the invention with a machine as performing this operation manually would cause stress injuries in the wrists.

Alongside the track 1 upstream of a wrapping station lies a hot-setting adhesive application station, including a sizing orifice 3 which is located above the outer cardboard 2 near one of its lateral edges. The location of package blanks manually loaded on the conveyor in the cross-track direction may vary and the same applies to the length of a sheet of cardboard 2 in the cross-track direction. Thus, the location of the sizing orifice 3 must be set separately for each package. Therefore, the sizing orifice 3 is mounted on cross guides 17, along which it is operable by means of a pneumatic cylinder 16. An electric eye included in the orifice 3 detects the outer edge of cardboard 2 and stops the sizing orifice always at a certain distance therefrom. In the case of long series driven with the same package blank, whose sufficient centering is taken care of, the orifice 3 may remain stationary until it is shifted to a new position as the package blank is replaced with a new one.

The wrapping station includes transverse belts 5, which extend below track 1 or are fastened by the ends thereof alongside the edges of track 1. The track 1 must have a width which is less than that of a finished package for extending the free section of said belts 5 at least to some extent below the edges of a book to be wrapped. On either side of the track there are two parallel belts 5, the floor plate of a wrapping station being provided with slots or recesses therefor in such a manner that the belts will be able to descend to the floor level of a wrapping station in view of preventing the leading edge of a package blank from colliding with the belts upon arriving in the wrapping station on top of the belts. The outer ends of belts 5 can be twined around spring-loaded cylinders (not shown) or joined as a loop which is maintained in permanent tension by means of spring-loaded reversing rollers (not shown). What is essential is that the belts 5 can be pulled to a more or less full view from the track level while still keeping the belts 5 tight.

On either side of the track 1 there is a pair of guides consisting of two guides 8. Each pair of guides 8 is mounted on a frame tube or girder 12 to be operable by means of vertical guideways 10 and horizontal guideways as a single unit in vertical and horizontal direction. Each pair of guides 8 is provided with sensor elements 9, which are movable therewith and whose operation will be described hereinafter. The bottom edge of each guide 8 is provided with a slot for passing the belt 5 therethrough in a sliding fashion. Naturally, the element limiting the slot and supporting the belt 5 may be a thin cylinder or needle bearing with no actual sliding occurring between belt 5 and guide 8. What is essential is that, in its longitudinal direction, the belt 5 is capable of passing through a slot included in the guide 8.

Each pair of guides 8 is adapted to be operable in vertical direction by means of pneumatic cylinders 11 and in horizontal direction by means of pneumatic cylinders 14, whose cylinder end closer to the piston rod is fastened to a body 13. In horizontal direction, said guides 8 are movable symmetrically towards or away from each other. In vertical direction, on the other hand, said guides 8 can be movable non-simultaneously, since the pairs of guides 8 mounted on the opposite sides of the track are provided with their own cylinders 11 for vertical action.

Figure 3:
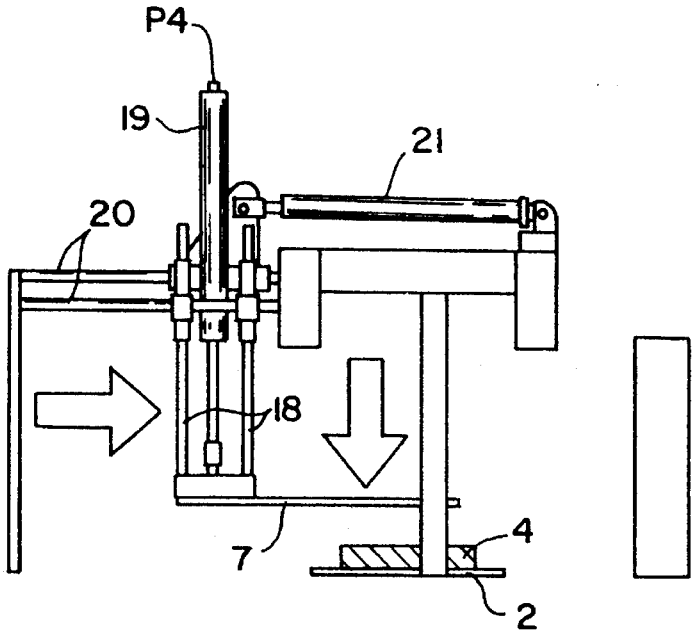
FIG. 3 is a side view of press elements used during a package folding operation for holding a package blank in contact with the track.

In the middle of a wrapping station above the track lies a press plate 6, movable in vertical direction by means of a pneumatic cylinder 15. Upstream of the press plate 6 lies a second press element, including two parallel, horizontal or flat plates 7 which are unsupported by one end thereof, as shown in FIG. 3. The press plates 7 are fastened by the other end thereof to the bottom end of vertical guideways 18 and the vertical guideways are in turn braced to horizontal guideways 20. Thus, the press plates 7 can be operated by means of pneumatic cylinders 19 and 21 in vertical and horizontal direction.

Figure 4:
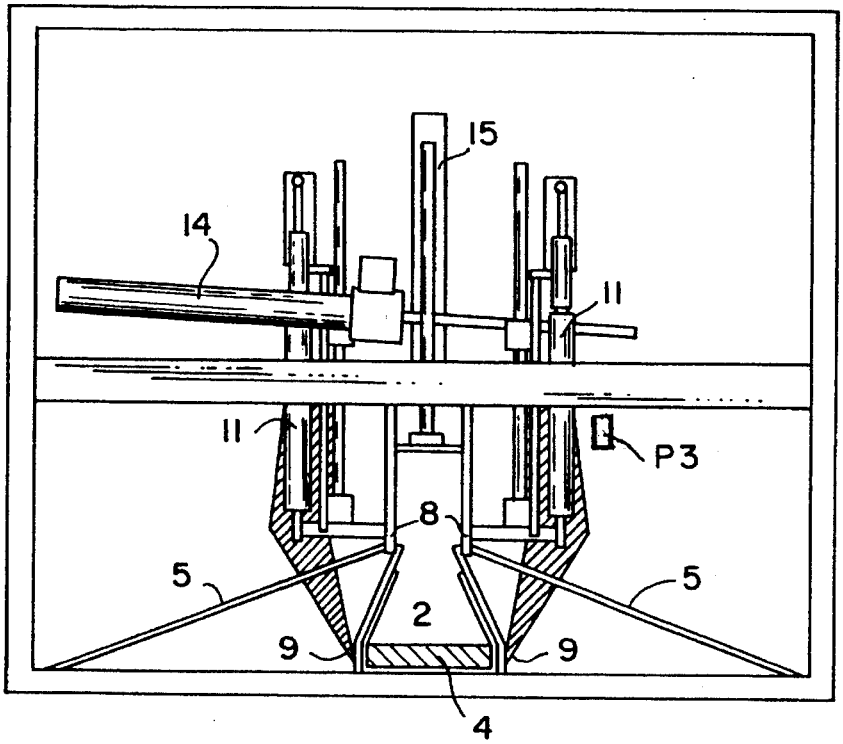
FIGS. 4–7 illustrate the same as FIG. 2 but in each figure the mechanical components have advanced to the next wrapping operation.

The apparatus operates as follows. After driving a package blank to a position on top of the belts 5, the lifting of belts 5 is initiated by cylinders 11, as shown in FIG. 2. Prior to initiating the lifting, the press plates 7 are pressed against the top side of a blank 4 for maintaining the blank in contact with the track during the folding of cardboard 2. During the final stage of lifting the belts 5, the cylinder 14 is operated for pulling the guides 8 towards each other reaching the condition shown in FIG. 4, wherein the ends of the sheet of cardboard 2 are directed obliquely upwards in a position inclined towards each other. At this time the sensor elements 9 come into contact with the sides of the package blank. The sensor elements 9 can be slightly yielding for increasing the leaning pressure as the guides 8 approach each other. As the leaning pressure of sensor elements 9 becomes sufficiently high, e.g. in the position shown in FIG. 4, said sensor elements 9 deliver a control message to the-valve of cylinder 14, which stops the movement of guides 8 towards each other.

Figure 5:
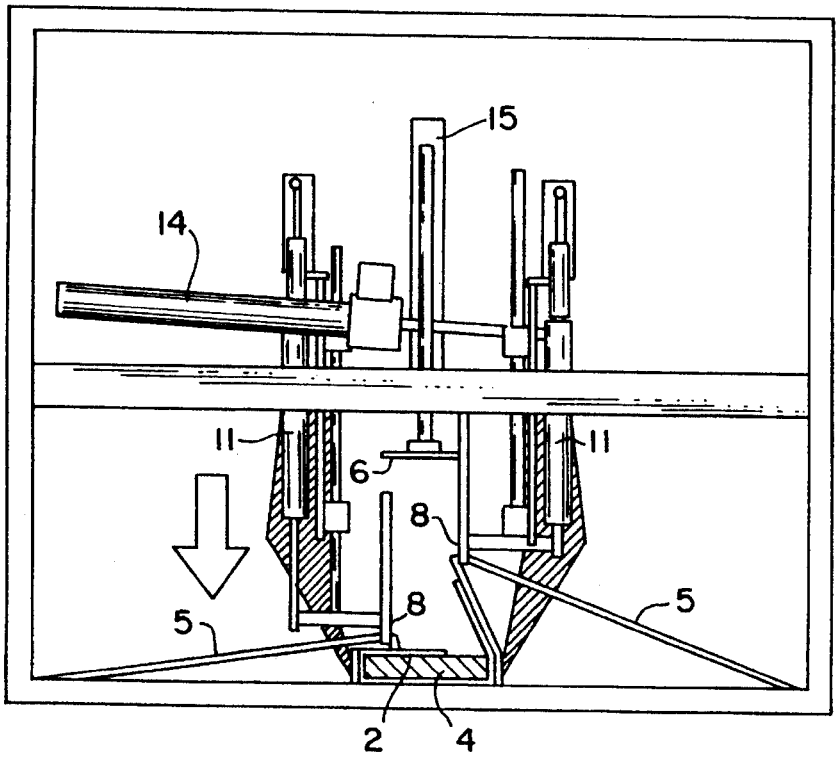

FIG. 5 illustrates the following stage, wherein the cylinder 11 on the left, i.e. located on the side of the track opposite to the orifice 3, presses down the corresponding pair of guides 8 for folding one end of the sheet of cardboard 2 against the top side of the package blank. At the same time, the press plates 7 are retracted from underneath the foldable end sections of outer cardboard 2 with a movement parallel to the track 1 along guideways 20 (FIG. 3) by using the power of a cylinder 21.

Figure 6:
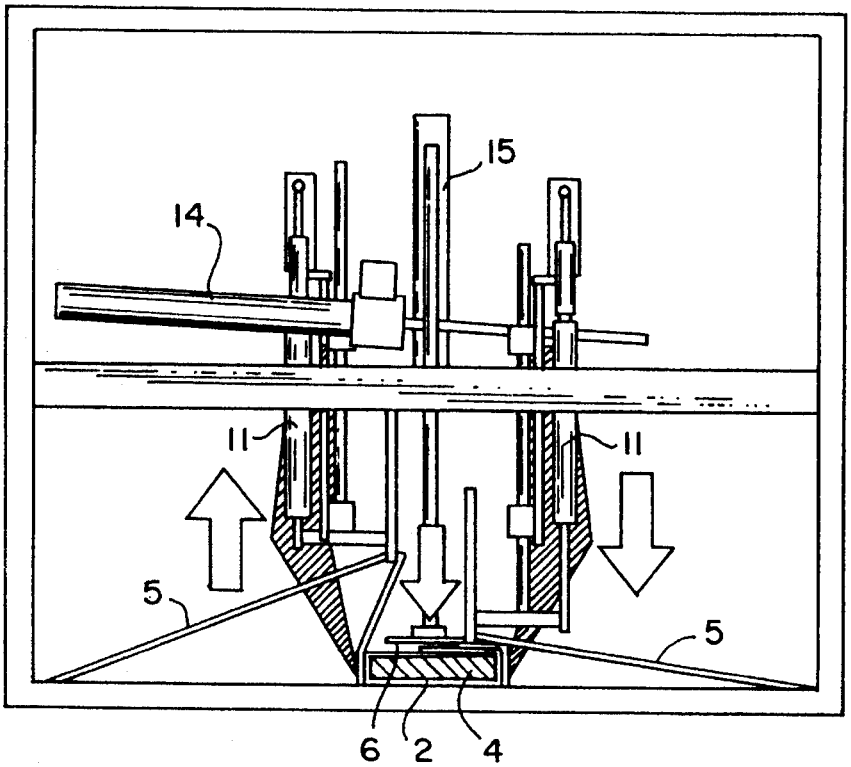

In FIG. 6, the operation has progressed to a stage, wherein the left-hand cylinder 11 effects a lifting action and the right-hand cylinder 11 lowers down the respective guide 8and its accompanying belt 5 for folding down also the other, adhesive-carrying end section of cardboard 2 and overlapping it on top of the first end section. A cylinder 15 presses down the press plate 6. The press plate 6 compresses the end sections of the sheet of cardboard 2 against each other along the entire length of the sizing joint with a sufficient force and duration for fastening the end sections of the sheet of cardboard 2 to each other. A hot-setting adhesive becomes sufficiently adherent in just a few seconds after its injection for preventing the package from opening by itself until the final setting is achieved.

Figure 7:
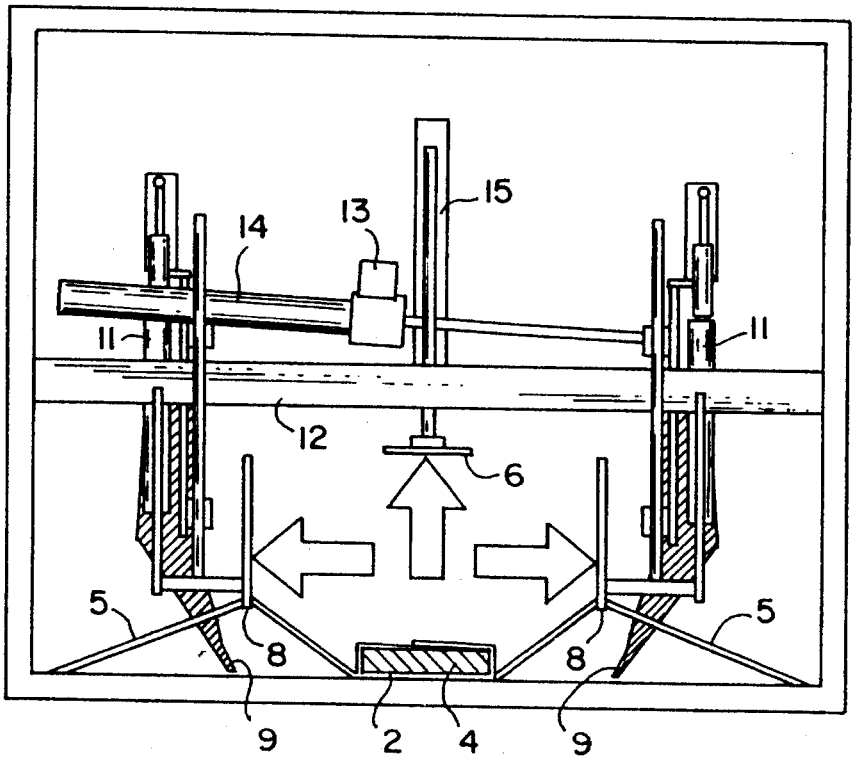

FIG. 7 illustrates a condition, wherein the guides 8 and the press plate 6 are withdrawn from a finished package and from each other. The press plate 6 is not removed from the top side of the package until the belts 5 are lowered by means of guides 8 down to the track level or at least close to it. Thus, FIG. 7 illustrates the situation with the belts 5 still substantially elevated, whereby the press plate 6 could still lie against the top side of a package. Finally, the conveyor belt 1, which has been stationary, can be actuated for removing a finished package from the wrapping station and for bringing a fresh package blank in.

I claim:

1. A method for wrapping an object comprising:

supporting a cardboard piece having opposite sides on a conveyor having a wrapping station, at least one pair of elongated belts extending transverse to the conveyor, one belt on either side of the conveyor, and a pair of guides, one guide on each side of the conveyor, each guide movably supporting one of the belts;

engaging a press element with an object on the cardboard piece to hold the object and cardboard piece against the conveyor;

folding the cardboard piece at the wrapping station by moving the guides upwardly, then toward one another, then alternately downwardly such that the belts fold sections of the cardboard piece first upwardly then alternately on top of one another in overlapping fashion; and disengaging the press element from the object during said folding.

2. The method of claim 1 including applying an adhesive to one of the cardboard sections prior to folding the cardboard sections.

3. The method of claim 2 including pressing the overlapped sections of the cardboard piece with a second press element to form a tube surrounding the object.

4. The method of claim 3 including sensing the sides of the object with a sensor on each of the guides and stopping movement of the guides toward one another in response to the sensing of the sides by the sensors prior to moving the guides downwardly.

5. The method of claim 4 wherein the sensors are connected to a control, said method including controlling movement of the guides with at least one power unit in response to the control.

6. The method of claim 1 including moving said guides with at least one power unit.

7. The method of claim 3 including engaging and disengaging said press element with at least one power unit.

8. The method of claim 1 including pressing the overlapped sections of the cardboard piece with a second press element after the cardboard piece sections are folded on top of one another to form a tube surrounding the object.

9. The method of claim 1 including sensing the sides of the object with a sensor on each of the guides and stopping movement of the guides toward one another in response to the sensing of the sides by the sensors prior to moving the guides downwardly.

10. A method for wrapping an object with cardboard or the like comprising:

supporting an object on a cardboard piece on a conveyor, the cardboard piece having sections extending beyond opposite sides of the object;

engaging a press element with the top of the object to hold the object and cardboard piece against the conveyor;

folding the extending, opposite sections of the cardboard piece over and against the object by moving a pair of belts upwardly to engage the extending, opposite sections, then toward one another, then alternately downwardly such that the cardboard sections are folded alternately in overlapped fashion on top of one another against the top of the object, said belts being located under the cardboard piece with at least one belt on each side of the conveyor, each belt extending transverse to the direction of the conveyor.

11. The method of claim 10 including disengaging the press element from the object during folding of the cardboard sections.

12. The method of claim 10 including guiding the movement of the belts with guides activated by at least one power unit.

13. The method of claim 12 including sensing the sides of the object with a sensor on each of the guides and stopping movement of the guides toward one another in response to the sensing of the sides by the sensors prior to moving the guides downwardly.

14. The method of claim 13 wherein the sensors are connected to a control, said method including controlling movement of the guides with at least one power unit in response to the control.

15. The method of claim 10 including applying adhesive to one of the cardboard sections prior to folding the cardboard sections with the belts.

16. The method of claim 15 including pressing the overlapped sections of the cardboard piece with a second press element to form a tube surrounding the object.

* * * * *